US010186390B2

(12) United States Patent
Fukumoto et al.

(10) Patent No.: US 10,186,390 B2
(45) Date of Patent: Jan. 22, 2019

(54) RELAY CIRCUIT FOR CONTACT PRESERVATION AND METHOD FOR CONTROLLING RELAY CIRCUIT

(71) Applicant: OMRON Corporation, Kyoto-shi, Kyoto (JP)

(72) Inventors: Tetsuya Fukumoto, Kusatsu (JP); Toshiyuki Higuchi, Kusatsu (JP)

(73) Assignee: OMRON Corporation, Kyoto-shi (JP)

( * ) Notice: Subject to any disclaimer, the term of this patent is extended or adjusted under 35 U.S.C. 154(b) by 153 days.

(21) Appl. No.: 14/879,223

(22) Filed: Oct. 9, 2015

(65) Prior Publication Data

US 2016/0225563 A1 Aug. 4, 2016

(30) Foreign Application Priority Data

Feb. 2, 2015 (JP) ..... 2015-018894

(51) Int. Cl.
*H01H 47/22* (2006.01)
*H01H 50/44* (2006.01)
(Continued)

(52) U.S. Cl.
CPC ..... *H01H 47/22* (2013.01); *H01H 47/004* (2013.01); *H01H 50/44* (2013.01); *H01H 50/86* (2013.01)

(58) Field of Classification Search
CPC ..... H01H 47/22; H01H 50/86; H01H 50/44; H01H 47/004; H01H 47/325;
(Continued)

(56) References Cited

U.S. PATENT DOCUMENTS 6,870,723 B1 3/2005 Kramer
7,573,693 B2 * 8/2009 Hornung ..... H02H 9/047 361/111
(Continued)

FOREIGN PATENT DOCUMENTS

DE 3541338 A1 5/1987
DE 102004033359 A1 * 2/2006 ..... H01H 47/004
(Continued)

OTHER PUBLICATIONS

Office action dated Aug. 21, 2018 in a counterpart Japanese patent application.
(Continued)

*Primary Examiner* — Thienvu Tran
*Assistant Examiner* — Nicolas Bellido
(74) *Attorney, Agent, or Firm* — Metrolexis Law Group, PLLC

(57) ABSTRACT

Provided is a relay unit that is inexpensive and has a long life, and a method for controlling a relay circuit. A series circuit of mechanical switches is connected in series to a load and a load power supply, and a control unit selects one of the mechanical switches as a selected switch, and performs a switching timing shift, which is constituted by at least one of a first operation in which the selected switch is switched to the closed state after the mechanical switch other than the selected switch, and a second operation in which the selected switch is switched to the open state prior to the mechanical switch other than the selected switch.

4 Claims, 2 Drawing Sheets

(51) Int. Cl.
*H01H 50/86* (2006.01)
*H01H 47/00* (2006.01)

(58) Field of Classification Search
CPC .. H01H 33/6662; H01H 47/001; H02H 3/247; H02H 3/04; H02H 3/093; H02H 1/0007; H02H 3/044; H03F 1/52; F02D 41/20; H01F 7/1816; H01F 7/1844; G01R 31/3278; G01R 31/3277; G01R 31/06; G01R 31/3336; G01R 31/3272; G01R 31/3333; H04Q 1/20; G04F 8/08
USPC ..... 361/189, 139; 324/423, 424
See application file for complete search history.

(56) References Cited

U.S. PATENT DOCUMENTS

2002/0130557 A1* 9/2002 Dickhoff ..... H01H 47/004 307/113
2007/0182255 A1* 8/2007 Schneiderheinze ..... G05B 9/02 307/125
2009/0251835 A1* 10/2009 Meinherz ..... H01H 47/004 361/91.1
2013/0033345 A1* 2/2013 Hirao ..... H01H 50/642 335/185
2016/0223614 A1* 8/2016 Fukumoto ..... G01R 31/3278
2016/0225560 A1* 8/2016 Fukumoto ..... G01R 31/028
2016/0225561 A1* 8/2016 Fukumoto ..... H01H 47/002

FOREIGN PATENT DOCUMENTS

DE 102012006440 A1 * 10/2013 ..... H01H 47/004
EP 1202313 A1 5/2002
JP 2003-514361 A 4/2003
JP 2006-338924 A 12/2006
JP 2007-35388 A 2/2007
JP 2007-213842 A 8/2007
JP 2008-66099 A 3/2008
JP 2011-228066 A 11/2011
JP 2012-142195 A 7/2012
WO 0139229 A1 5/2001
WO WO 2006002725 A1 * 1/2006 ..... H01H 47/004

OTHER PUBLICATIONS

Office Action dated May 22, 2018 in a counterpart Japanese patent application.

* cited by examiner

RELAY CIRCUIT FOR CONTACT PRESERVATION AND METHOD FOR CONTROLLING RELAY CIRCUIT

CROSS-REFERENCE TO RELATED APPLICATION

This application claims priority to Japanese Patent Application No. 2015-018894 filed Feb. 2, 2015, the entire contents of which are incorporated herein by reference.

FIELD

The present invention relates to a relay unit including a series circuit in which mechanical switches respectively provided in a plurality of contact relays are connected in series to each other, and that is connected in series to a load and a load power supply, and a method for controlling a relay circuit.

BACKGROUND

The following configuration is known as a relay unit (relay circuit) that has the function of switching between current flow and no current flow to a load using contact relays.

That is, the relay unit includes a series circuit in which mechanical switches respectively provided in a plurality of contact relays are connected in series to each other. This series circuit is connected in series to a load and a load power supply. When all the mechanical switches are in the closed state, current flows through the load. On the other hand, when at least one of the mechanical switches is in the open state, the current flow through the load is interrupted. Examples of the relay unit are disclosed in European Patent No. 1202313 and German Patent No. 3541338.

The specifications of European Patent No. 1202313 (May 2, 2002) and German Patent No. 3541338 (May 27, 1987) are examples of background art.

When all but one mechanical switch are in the closed state and this one mechanical switch is switched from the open state to the closed state, current starts to flow through the load. On the other hand, when all the mechanical switches are in the closed state and one mechanical switch is switched from the closed state to the open state, the current flow through the load is interrupted. In both cases, at the moment at which the one mechanical switch is switched, an arc occurs from this mechanical switch, causing a damage to the contacts of the mechanical switch. Accordingly, the life of the contact relay including the mechanical switch in which the arc occurred will be shortened. As a result, there is the problem that the life of the relay unit is shortened.

This is explained more specifically in the following: Conventionally, it is common that all the mechanical switches of the series circuit are switched at the same time. On the other hand, in the series circuit, it is common that timings at which the mechanical switches are opened/closed vary from each other due to individual differences between the mechanical switches, the wear of the contacts of the mechanical switches (that is caused by, for example, on/off switching of the mechanical switches), or the like. As a result, the arc occurs intensively when a specific mechanical switch is switched, and the life of the contact relay including this specific mechanical switch is extremely shortened as compared with other contact relays.

Since the short life contact relay depends on the variation in the above-described timing at which the mechanical switch is opened/closed, it is difficult to specify this short life contact relay at the time of manufacturing of the relay unit. Therefore, in order to avoid the problem of the life of the relay unit, it is necessary to replace all the contact relays by non-contact relays or high arc-resistance relays. However, non-contact relays and high arc-resistance relays are more expensive than general-purpose contact relays, and thus it is difficult to realize an inexpensive relay unit when all the contact relays are replaced by non-contact relays or high arc-resistance relays.

The present invention was made in view of the above-described problem, and an objective thereof is to provide a relay unit that is inexpensive and has a long life, and a method for controlling a relay circuit.

SUMMARY

In order to solve the above-described problems, an inventive relay unit includes: a series circuit in which mechanical switches respectively provided in a plurality of contact relays are connected in series to each other; and a control unit configured to switch the mechanical switches constituting the series circuit between an open state and a closed state, wherein the series circuit is connected in series to a load and a load power supply, and the control unit is configured to select one of the mechanical switches as a selected switch, and to perform a switching timing shift, which is constituted by at least one of a first operation in which the selected switch is switched to the closed state after the mechanical switch or switches other than the selected switch, and a second operation in which the selected switch is switched to the open state prior to the mechanical switch or switches other than the selected switch.

Furthermore, in order to solve the above-described problems, an inventive method for controlling a relay circuit is provided, the relay circuit including: a series circuit in which mechanical switches provided in a plurality of contact relays are connected in series to each other, and that is connected in series to a load and a load power supply, the method including: controlling switching of the mechanical switches constituting the series circuit between an open state and a closed state, wherein in the controlling step, one of the mechanical switches is selected as a selected switch, and a switching timing shift is performed, which is constituted by at least one of a first operation in which the selected switch is switched to the closed state after the mechanical switch or switches other than the selected switch, and a second operation in which the selected switch is switched to the open state prior to the mechanical switch or switches other than the selected switch.

According to the above-described configuration, when a switching timing shift is performed, the above-described arc will occur at the moment at which the selected switch is switched. In other words, by the control of the control unit (in the controlling step), it is possible to select the mechanical switch in which this arc will occur.

Accordingly, by letting arcs occur in the mechanical switches provided in different contact relays during a plurality of switching timing shifts, it is possible to distribute the occurrence of an arc of the mechanical switch over the plurality of contact relays. Alternatively, by setting in advance at least one contact relay to be a high arc-resistance relay, and intentionally letting an arc occur in the mechanical switch of this high arc-resistance relay, the occurrence of an arc of a mechanical switch can be concentrated in this high arc-resistance relay. Accordingly, it is possible to achieve a relay unit with a longer life.

Furthermore, according to this configuration, it is not necessary to replace all the contact relays by non-contact relays or high arc-resistance relays, and thus it is possible to realize an inexpensive relay unit.

The same applies to the case where a relay circuit is controlled so as to realize the same function as that of the relay unit.

Furthermore, in the relay unit of the present invention, it is preferable that the control unit be configured to select the mechanical switches serving as the selected switches from different contact relays when the switching timing shift is performed twice in succession.

According to this configuration, it is possible to change the contact relay including the selected switch in terms of one switching timing shift. Accordingly, it is possible to distribute the occurrence of an arc of the mechanical switch over the plurality of contact relays.

Furthermore, in the relay unit of the present invention, it is preferable that the control unit be configured to select one of the mechanical switches as a selected switch so that probabilities that the respective mechanical switches are selected as a selected switch from the contact relays are uniform.

According to this configuration, it is possible to distribute the occurrence of an arc of the mechanical switch uniformly over the plurality of contact relays. It is thus possible to achieve a relay unit with a sufficiently longer life.

Furthermore, in the relay unit of the present invention, it is preferable that the plurality of contact relays include a general-purpose relay, and a high resistance relay that has a higher arc resistance than the general-purpose relay, and the control unit be configured to select one of the mechanical switches as a selected switch from the high resistance relay for every switching timing shift.

According to this configuration, it is possible to concentrate the occurrence of an arc of the mechanical switch in the high resistance relay, which is a high arc-resistance relay. As a result, it is possible to suppress a reduction in the life of the general-purpose relay, and to achieve a relay unit with a longer life.

According to the present invention, it is possible to provide a relay unit that is inexpensive and has a long life, and a method for controlling a relay circuit.

DETAILED DESCRIPTION

Embodiments for implementing the present invention will be described with reference to FIGS. 1 and 2.

Figure 1:
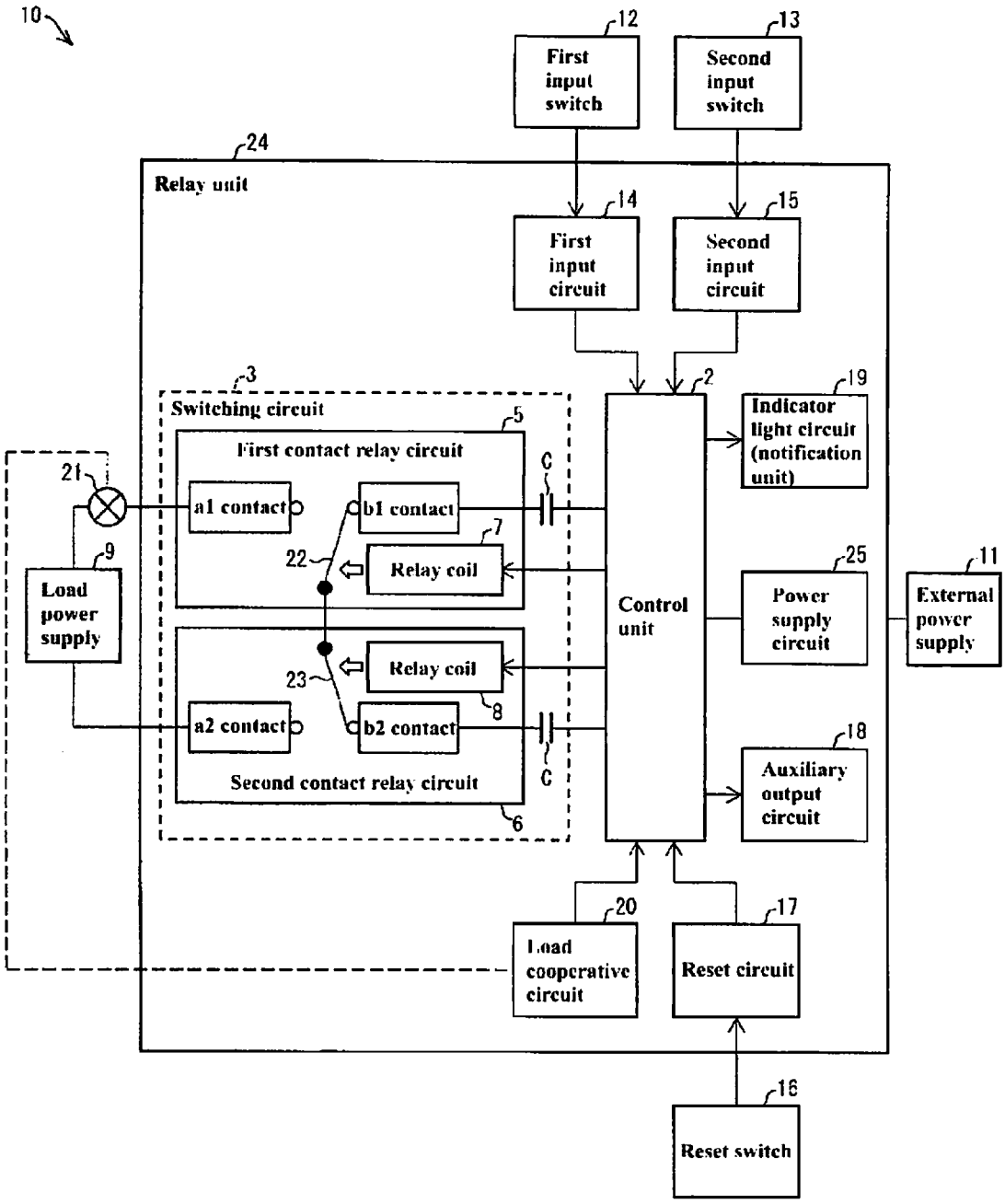
FIG. 1 is a circuit block diagram illustrating a schematic configuration of a load controlling system provided with a relay unit according to the present invention, in which mechanical switches are in the open state.
Figure 2:
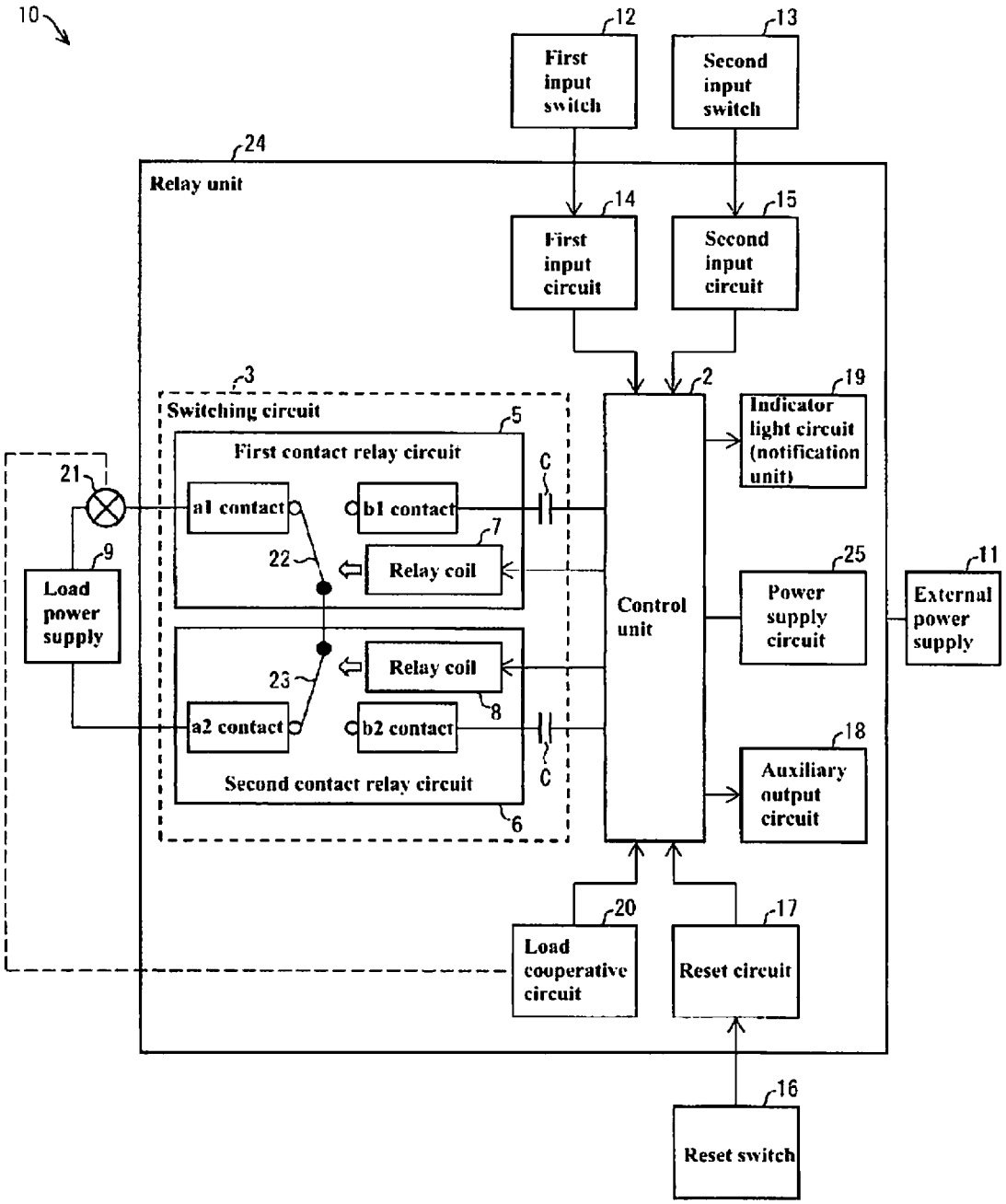
FIG. 2 is a circuit block diagram illustrating a schematic configuration of the load controlling system provided with the relay unit according to the present invention, in which the mechanical switches are in the closed state.

FIGS. 1 and 2 are circuit block diagrams illustrating schematic configurations of a load controlling system 10 provided with a relay unit 24. FIG. 1 shows the state in which mechanical switches 22 and 23 are in the open state, and FIG. 2 shows the state in which the mechanical switches 22 and 23 are in the closed state.

The load controlling system 10 is a system for switching between current flow and no current flow through a load 21 using the relay unit 24. Note that a load power supply 9 is an AC power supply that serves as a power supply for the load 21.

The relay unit 24 includes a control unit 2 and a switching circuit (relay circuit) 3.

The switching circuit 3 includes two (or multiple) contact relays, namely, a first contact relay circuit (contact relay) 5 and a second contact relay circuit (contact relay) 6.

The first contact relay circuit 5 includes a mechanical switch 22 and a relay coil 7. The first contact relay circuit 5 generates an electromagnetic force using excitation of the relay coil 7 and uses this electromagnetic force to switch the mechanical switch 22 between the open state and the closed state. Note that the first contact relay circuit 5 includes, as contacts of the mechanical switch 22, an a1 contact, which is a so-called "a" contact, and a b1 contact, which is a so-called "b" contact. In the specification of the present application, "the closed state of the mechanical switch 22" refers to the state in which the mechanical switch 22 is in contact with the a1 contact. On the other hand, in the specification of the present application, "the open state of the mechanical switch 22" refers to the state in which the mechanical switch 22 is in contact with the b1 contact.

The second contact relay circuit 6 includes a mechanical switch 23 and a relay coil 8. The second contact relay circuit 6 generates an electromagnetic force using excitation of the relay coil 8, and uses this electromagnetic force to switch the mechanical switch 23 between the open state and the closed state. Note that the second contact relay circuit 6 includes, as contacts of the mechanical switch 23, an a2 contact, which is a so-called "a" contact, and a b2 contact, which is a so-called "b" contact. In the specification of the present application, "the closed state of the mechanical switch 23" refers to the state in which the mechanical switch 23 is in contact with the a2 contact. On the other hand, in the specification of the present application, "the open state of the mechanical switch 23" refers to the state in which the mechanical switch 23 is in contact with the b2 contact.

Furthermore, the mechanical switches 22 and 23 are connected in series to each other to constitute a series circuit, and this series circuit is connected in series to the load 21 and the load power supply 9. Accordingly, when all the mechanical switches 22 and 23 are in the closed state, current starts to flow through the load 21. On the other hand, when at least one of the mechanical switches 22 and 23 is in the open state, the current flow through the load 21 is interrupted.

Furthermore, the switching circuit 3 includes two capacitors C. These capacitors C are provided in order to insulate and separate the load power supply 9 from an external power supply 11.

The control unit 2 includes one or more microcomputers (microcontrollers), and is configured to perform overall control of the relay unit 24. Particularly, the control unit 2 controls switching of the mechanical switches 22 and 23 by controlling whether or not to excite each of the relay coils 7 and 8. Note that the external power supply 11 is a DC power supply that serves as a power supply for the relay unit 24, and supplies power to the control unit 2 via a power supply circuit 25 included in the relay unit 24. If the control unit 2 includes a plurality of microcomputers, which perform the same processing, the processing is made redundant and more accurate control is possible, making the load controlling system 10 safer.

Furthermore, the relay unit 24 includes a first input circuit 14, a second input circuit 15, a reset circuit 17, an auxiliary output circuit 18, an indicator light circuit (notification unit)

19, and a load cooperative circuit 20. Furthermore, in the load controlling system 10, a first input switch 12, a second input switch 13, and a reset switch 16 are connected to the relay unit 24.

The first input switch 12 and the second input switch 13 may respectively be, for example, an emergency stop switch and a safety sensor, and are provided in order to reliably operate the load controlling system 10. The first input circuit 14 converts a signal generated by on/off switching of the first input switch 12 into a signal of a format that can be processed appropriately by the control unit 2 and supplies the converted signal to the control unit 2. The second input circuit 15 converts a signal generated by on/off switching of the second input switch 13 into a signal of a format that can be processed appropriately by the control unit 2 and supplies the converted signal to the control unit 2.

The reset switch 16 is a manual switch that is provided in order to reliably operate, together with the first input switch 12 and the second input switch 13, the load controlling system 10. The reset circuit 17 converts a signal generated by pressing of the reset switch 16 into a signal of a format that can be processed appropriately by the control unit 2, and supplies the converted signal to the control unit 2.

The auxiliary output circuit 18 is a circuit for use in, for example, controlling of the load controlling system 10 by an external device (not shown), and outputs a result of detecting whether current flows or does not flow through the load 21 to the outside of the load controlling system 10.

The indicator light circuit 19 emits light or blinks depending on the state of the load controlling system 10, and performs notification so that the state of the load controlling system 10 can be viewed.

The load cooperative circuit 20 is associated with the state and/or operation of the load 21, and is configured to convert a signal that is generated depending on, for example, various types of states and/or operations of the load 21 into a signal of a format that can be processed appropriately by the control unit 2, and supplies the converted signal to the control unit 2.

Furthermore, the control unit 2 selects one of the mechanical switches 22 and 23 as a selected switch, and performs a switching timing shift. Note that a method in which the control unit 2 selects a switch as a selected switch may be, for example, the following (a) or (b).

(a) A method in which one of the mechanical switches 22 and 23 that has previously been selected as a selected switch the least number of times is selected as a selected switch.

(b) A method in which one of the mechanical switches 22 and 23 that is to be selected as a selected switch is associated in advance with each switching timing shift, and selection of a switch as a selected switch is performed based on this association relationship.

More specific examples of the switching timing shift will be described. Examples of the switching timing shift include a "contact arc distribution method" and a "contact arc concentration method". The following will describe both the "contact arc distribution method" and "contact arc concentration method". In the description, it is assumed that one operation of the relay unit 24 refers to a time period from starting current flow through the load 21 to stopping the current flow through the load 21.

<Contact Arc Distribution Method>

The mechanical switch 22 is selected as a selected switch at the time of the N-th operation of the relay unit 24 (where N is an arbitrary positive integer). Here, when current flow through the load 21 is started, the mechanical switch 23 is first switched from the open state to the closed state, and then the mechanical switch 22 is switched from the open state to the closed state (first operation). Thereafter, when the current flow through the load 21 is interrupted, the mechanical switch 22 is first switched from the closed state to the open state, and then the mechanical switch 23 is switched from the closed state to the open state (second operation). At this N-th operation of the relay unit 24, it is always the case that an arc occurs from the mechanical switch 22 at the moment at which the mechanical switch 22 is switched, but no arc occurs from the mechanical switch 23 at the moment at which the mechanical switch 23 is switched.

The mechanical switch 23 is selected as a selected switch at the time of the N+1-th operation of the relay unit 24. Here, when current flow through the load 21 is started, the mechanical switch 22 is first switched from the open state to the closed state, and then the mechanical switch 23 is switched from the open state to the closed state (first operation). Thereafter, when the current flow through the load 21 is interrupted, the mechanical switch 23 is first switched from the closed state to the open state, and then the mechanical switch 22 is switched from the closed state to the open state (second operation). At this N+1—the operation of the relay unit 24, it is always the case that an arc occurs from the mechanical switch 23 at the moment at which the mechanical switch 23 is switched, but no arc occurs from the mechanical switch 22 at the moment at which the mechanical switch 22 is switched.

The N-th operation of the relay unit 24 corresponds to one switching timing shift, and the N+1-th operation of the relay unit 24 corresponds to another switching timing shift.

Accordingly, it is possible to distribute the occurrence of an arc among the mechanical switch 22 (first contact relay circuit 5) and the mechanical switch 23 (second contact relay circuit 6). It is thus possible to achieve the relay unit 24 with a longer life.

This method can be regarded as a method in which in two successive switching timing shifts (switching operations), the control unit 2 selects a switch (the mechanical switch 22 or 23) as the selected switch from the different contact relays (the first contact relay circuit 5 and the second contact relay circuit 6). By using this method, it is possible to change the contact relay including this selected switch at every single switching timing shift. Accordingly, it is possible to distribute the occurrence of an arc in mechanical switch over the plurality of contact relays.

Furthermore, this method includes a further preferable example in which the control unit 2 selects a switch as a selected switch so that probabilities that the respective switches (the mechanical switch 22 and 23) are selected as a selected switch from the contact relays (the first contact relay circuit 5 and the second contact relay circuit 6) are uniform. A method for realizing this may be, for example, a method in which switching between a case where the mechanical switch 22 is selected as a selected switch and a case where the mechanical switch 23 is selected as a selected switch is performed every M-th switching timing shift (where M is a suitable positive integer). Accordingly, it is possible to uniformly distribute the occurrence of arcs in the mechanical switch over a plurality of contact relays. It is therefore possible to achieve the relay unit 24 with a sufficiently longer life.

<Contact Arc Concentration Method>

As a precondition, in the event of performing a contact arc concentration method, the first contact relay circuit 5 or the second contact relay circuit 6 needs to be a high arc-resistance relay (high resistance relay). Here, as an example, it is assumed that the second contact relay circuit 6 is a high arc-resistance relay, and the first contact relay circuit 5 is a general-purpose relay.

Each time the relay unit 24 is operated, the mechanical switch 23 is selected as a selected switch. Here, when current flow through the load 21 is started, the mechanical switch 22 is first switched from the open state to the closed state, and then the mechanical switch 23 is switched from the open state to the closed state (first operation). Thereafter, when the current flow through the load 21 is interrupted, the mechanical switch 23 is first switched from the closed state to the open state, and then the mechanical switch 22 is switched from the closed state to the open state (second operation). At the time of operation of this relay unit 24, it is always the case where an arc occurs from the mechanical switch 23 at the moment at which the mechanical switch 23 is switched, but no arc occurs from the mechanical switch 22 at the moment at which the mechanical switch 22 is switched.

Accordingly, it is possible to concentrate by design the occurrence of an arc in the mechanical switch 23 (second contact relay circuit 6, which is a high arc-resistance relay). This makes it possible to achieve the relay unit 24 with a longer life.

This method can be regarded as a method in which the control unit 2 selects the switch (mechanical switch 23) as a selected switch from the high resistance relay (second contact relay circuit 6) in every switching timing shift. Accordingly, the occurrence of an arc in the mechanical switch can be concentrated in the high resistance relay, which is a high arc-resistance relay. As a result, it is possible to prevent a reduction in the life of the general-purpose relay (first contact relay circuit 5), achieving the relay unit 24 with a longer life.

<Summary of Switching Timing Shift>

When a switching timing shift (which may also be referred to as "switching operation") is performed, an arc will occur at the moment at which the selected switch is switched. In other words, by the control of the control unit 2, it is possible to select one of the mechanical switches 22 and 23 in which an arc occurs.

Accordingly, it is possible to achieve the relay unit 24 with a longer life by the above-described contact arc distribution method or contact arc concentration method.

Furthermore, in both the contact arc distribution method and the contact arc concentration method, it is not necessary to replace both of the first contact relay circuit 5 and the second contact relay circuit 6 by non-contact relays or high arc-resistance relays, and thus an inexpensive relay unit 24 can be realized.

In the examples of the contact arc distribution method and the contact arc concentration method, the switching timing shift refers to a set of the operation (first operation) in which the selected switch is switched to the closed state after the mechanical switch other than the selected switch, and the operation (second operation) in which the selected switch is switched to the open state prior to the mechanical switch other than the selected switch. However, it is also possible that only the first or second operation is set as the switching timing shift. That is, in the contact arc distribution method, in one operation of the relay unit 24, the selected switch may be different between when the mechanical switches 22 and 23 are switched from the open state to the closed state, and when the mechanical switches 22 and 23 are switched from the closed state to the open state.

Hereinafter, the flow of the operation of the load controlling system 10 will be described briefly with reference to the following items (1) to (7). Note that in the initial state of the load controlling system 10, the external power supply 11, the first input switch 12, the second input switch 13, and the reset switch 16 are in the OFF state, and the load cooperative circuit 20 is in the ON state. Furthermore, in the same initial state, both the mechanical switches 22 and 23 are in the open state.

(1) The external power supply 11 is turned on and thereby the control unit 2 is started.

(2) The first input switch 12 and the second input switch 13 are turned on. Thereby, the load controlling system 10 is put in a safe state.

(3) The reset switch 16 is pressed and then the pressing is released.

(4) The control unit 2 recognizes that the item (2) has been performed based on signals supplied from the first input circuit 14 and the second input circuit 15. Furthermore, the control unit 2 recognizes that the item (3) has been performed based on a signal supplied form the reset circuit 17.

(5) The control unit 2 excites each of the relay coil 7 and 8 independently. This makes it possible for the mechanical switches 22 and 23 to be in the closed state at different timings, realizing the switching timing shift.

(6) When both the mechanical switches 22 and 23 are switched to the closed state, current flow through the load 21 is started.

(7) When at least one of the first input switch 12 and the second input switch 13 is turned off, both the mechanical switches 22 and 23 are switched to the open state, and the current flow through the load 21 is interrupted.

The open/close control of the mechanical switches 22 and 23 may be performed using, instead of the control unit 2, a circuit (hardware) for realizing switching of the mechanical switches 22 and 23 in accordance with the switching timing shift.

The description above is given taking a case in which two contact relays, namely, the first contact relay circuit 5 and the second contact relay circuit 6 are used as an example, but three or more contact relays may be used. When three or more contact relays are used, an advantage is more evident that is caused by selecting a switch as a selected switch so that probabilities that the respective switches are selected as a selected switch from the contact relays are uniform.

The above description will apply similarly to the case where the switching circuit 3 is controlled to realize the same function as that of the relay unit 24. That is, the present invention encompasses a method for controlling the switching circuit 3, and in this case, it can be construed that the control unit 2 of the load controlling system 10 executes the control step.

The present invention is not limited to the above-described embodiments, and various modifications are possible within the scope indicated in the Claims. The technical scope of the present invention also encompasses embodiments obtained by suitably combining technical means disclosed in different embodiments.

INDUSTRIAL APPLICABILITY

The present invention is applicable to a relay unit including a series circuit in which mechanical switches respectively provided in a plurality of contact relays are connected in series to each other and that is connected in series to a load and a load power supply, and to a method for controlling a relay circuit.

The invention claimed is:

1. A relay unit comprising:

a series circuit comprising mechanical switches respectively provided in a plurality of contact relays connected in series; and a control unit; wherein the series circuit is connected in series to a load and a load power supply;

the control unit is configured to perform processing operations comprising:

switching each of the mechanical switches between an open state and a closed state;

selecting one of the mechanical switches as a selected switch; and performing, in a first switching timing shift, processing operations comprising:

a first operation comprising switching the selected switch to the closed state and switching the mechanical switch or switches other than the selected switch to the closed state, wherein the selected switch is switched to the closed state after the mechanical switch or switches other than the selected switch, and a second operation comprising switching the selected switch to the open state and switching the mechanical switch or switches other than the selected switch to the open state, wherein the selected switch is switched to the open state prior to the mechanical switch or switches other than the selected switch; and the control unit is further configured to perform, in a second switching timing shift immediately succeeding the first switching timing shift, processing operations comprising:

a first operation comprising switching the selected switch to the closed state and switching the mechanical switch or switches other than the selected switch to the closed state, wherein the selected switch is switched to the closed state prior to the mechanical switch or switches other than the selected switch, and a second operation comprising switching the selected switch to the open state and switching the mechanical switch or switches other than the selected switch to the open state, wherein the selected switch is switched to the open state after the mechanical switch or switches other than the selected switch.

2. The relay unit according to claim 1, wherein the control unit selects one of the mechanical switches as the selected switch so that probabilities that the respective mechanical switches are selected as the selected switch are uniform.

3. A method for controlling a relay circuit, the relay circuit comprising: a series circuit comprising mechanical switches provided in a plurality of contact relays connected in series, mechanical switches capable of being switched between an open state and a closed state; and a control unit; wherein the series circuit is connected in series to a load and a load power supply, the method comprising:

selecting, via the control unit, one of the mechanical switches as a selected switch; and performing, via the control unit, a first switching timing shift comprising:

a first operation comprising switching the selected switch to the closed state and switching the mechanical switch or switches other than the selected switch to the closed state, wherein the selected switch is switched to the closed state after the mechanical switch or switches other than the selected switch, and a second operation comprising switching the selected switch to the open state and switching the mechanical switch or switches other than the selected switch to the open state, wherein the selected switch is switched to the open state prior to the mechanical switch or switches other than the selected switch; and performing, via the control unit, a second switching timing shift immediately succeeding the first switching timing shift comprising:

a first operation comprising switching the selected switch to the closed state and switching the mechanical switch or switches other than the selected switch to the closed state, wherein the selected switch is switched to the closed state prior to the mechanical switch or switches other than the selected switch, and a second operation comprising switching the selected switch to the open state and switching the mechanical switch or switches other than the selected switch to the open state, wherein the selected switch is switched to the open state after the mechanical switch or switches other than the selected switch.

4. The method according to claim 3, wherein selecting, via the control unit, one of the mechanical switches as the selected switch comprises selecting, via the control unit, one of the mechanical switches as the selected switch so that that probabilities that the respective mechanical switches are selected as the selected switch are uniform.

* * * * *